United States Patent [19]

Rinard

[11] 4,075,722

[45] Feb. 28, 1978

[54] SPACE FRAME SEAT ASSEMBLY

[75] Inventor: James Franklin Rinard, Newark, Del.

[73] Assignee: Hercules Incorporated, Wilmington, Del.

[21] Appl. No.: 754,374

[22] Filed: Dec. 27, 1976

[51] Int. Cl.[2] ..... A47C 23/00

[52] U.S. Cl. ..... 5/351; 297/DIG. 1; 297/DIG. 2; 297/455

[58] Field of Search ..... 5/351, 255, 260; 267/80, 110, 111; 297/DIG. 1, DIG. 2, 452, 455, 456

[56] References Cited

U.S. PATENT DOCUMENTS

| | | | |
|---|---|---|---|
| 2,803,293 | 8/1957 | Rowland | 267/111 |
| 3,259,435 | 7/1966 | Jordan | 297/DIG. 2 |
| 3,529,866 | 9/1970 | Getz | 297/DIG. 2 |
| 3,854,157 | 12/1974 | Trimble | 5/351 |

*Primary Examiner*—James C. Mitchell
*Attorney, Agent, or Firm*—James W. Peterson

[57] ABSTRACT

The invention is a space frame seat assembly that has utility as an automobile bench seat or the like, said assembly comprising a unitary space frame that can be injection molded in a simple two piece mold, said frame comprising a plurality of unique, repetitive structural cells, said frame being reinforced in a sandwich construction and having integral or detachable spring structure wherein the entire assembly is further foamed in place to create the finished assembly.

10 Claims, 7 Drawing Figures

SPACE FRAME SEAT ASSEMBLY

BACKGROUND OF THE INVENTION

In the past, bench seats for automobiles and the like have been manufactured from multiple piece steel frames, said pieces interconnected by weldment, bolts and other fasteners. The conventional metal frame then utilized a separate spring structure and layers of padding, all requiring extensive manual labor for assembly to complete the final assembly. The instant invention provides a unique, unitary injection molded space frame, having novel reinforcing means and having an integral spring structure, said entire assembly having padding foamed in place to provide a composite structure. The instant invention provides a bench seat for a typical automobile which is lighter, stronger and less expensive than the equivalent conventional automotive seat. Specifically, approximately forty pounds per automobile in weight savings is facilitated by a less expensive structure. The instant invention is an improvement over commonly owned U.S. Pat. No. 3,854,157 to Trimble which discloses a unitary space frame having certain novel structural features. Although it is known in the art, as shown by U.S. Pat. No. 3,768,864 to Niewulis, to foam in place a metal frame for a seating structure, it is felt that the instant invention provides a space frame that embodies a unique frame with reinforcement and integral spring construction as well as a foamed capsulation.

OBJECTS OF THE INVENTION

It is a principal of the instant invention to provide a space frame seat assembly that is the equivalent or superior to conventional metal automobile bench seat structures.

Another object of the instant invention is to provide a unitary assembly that is lighter in weight than conventional seat structures.

Still another object of the instant invention is to provide a seat assembly having a unitary frame having molded integral attachment areas.

Yet another object of the instant invention is to provide a low cost seating structure which can provide desired strength for safety and which is adaptable for contoured modernistic structures.

SUMMARY OF THE INVENTION

The purpose of the instant invention is to provide a composite seating assembly having a frame and spring assembly, if desired, that is injection moldable in a simple two piece mold. To accomplish this purpose, the instant invention provides a unitary frame having repetitive cells, each cell having substantially parallel yet offset upper and lower grids interconnected by connecting members that are parallel to the direction of mold opening travel and by a pair of side "Z" shaped member means in combination with a center diagonal "V" shaped member means, said cell being repeated in the integral unitary frame structure.

DESCRIPTION OF THE PREFERRED EMBODIMENT

Figure 1:
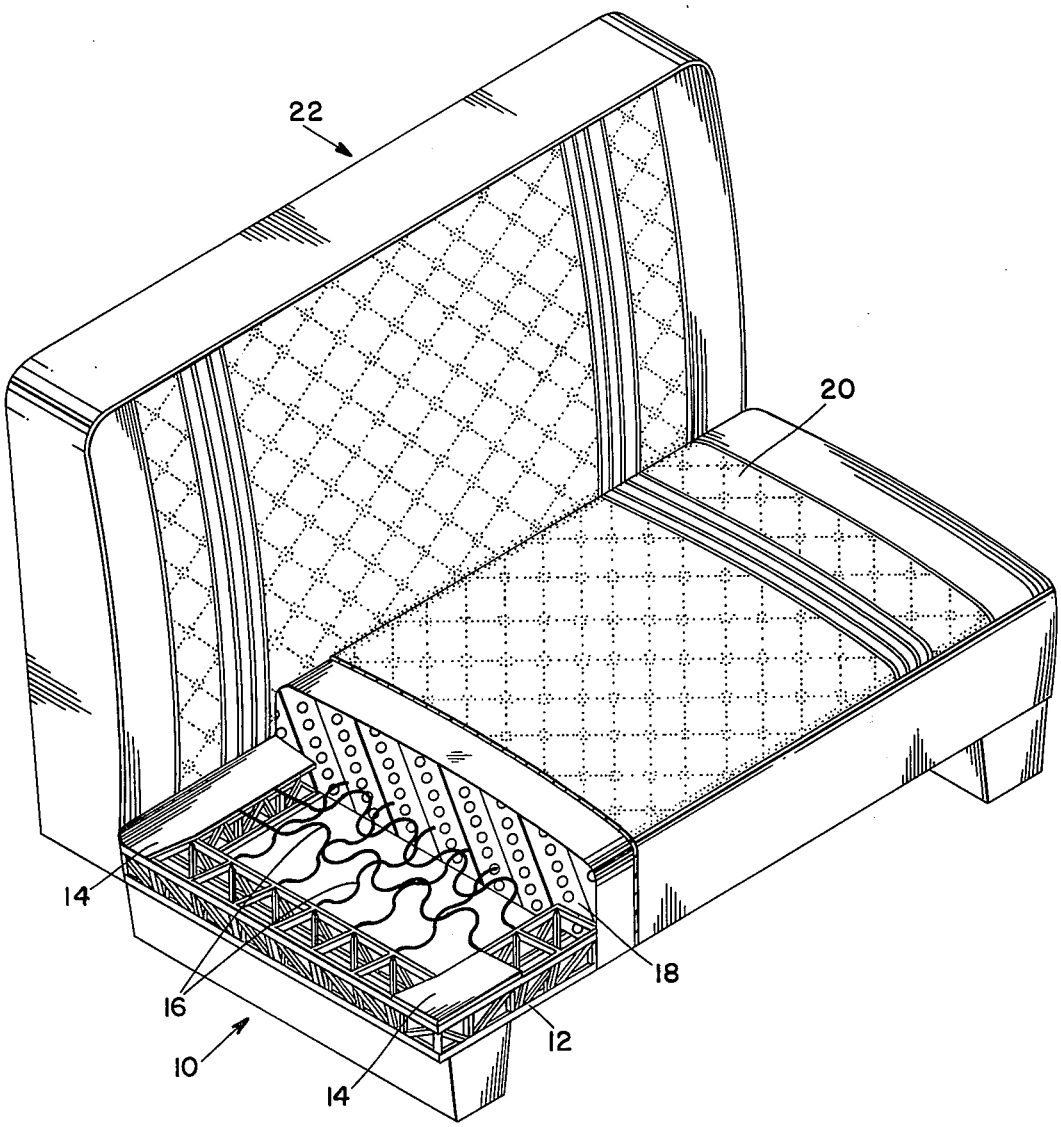
FIG. 1 shows a cutaway perspective view of the seat assembly of the instant invention.

With continued reference to the drawing, FIG. 1 illustrates seat assembly 10 of the instant invention having frame 12 reinforced by plate members 14, said frame 12 having integral spring members 16 all embedded in foam 18. A suitable upholstery 20 may be utilized for a finished seat. Seat back 22 of similar construction is attached to seat base, described previously, by attachment means which are not the subject of the instant disclosure. For the sake of simplicity, discussion of the novel seat assembly will be restricted to the base member, as shown in FIG. 1.

Figure 2:
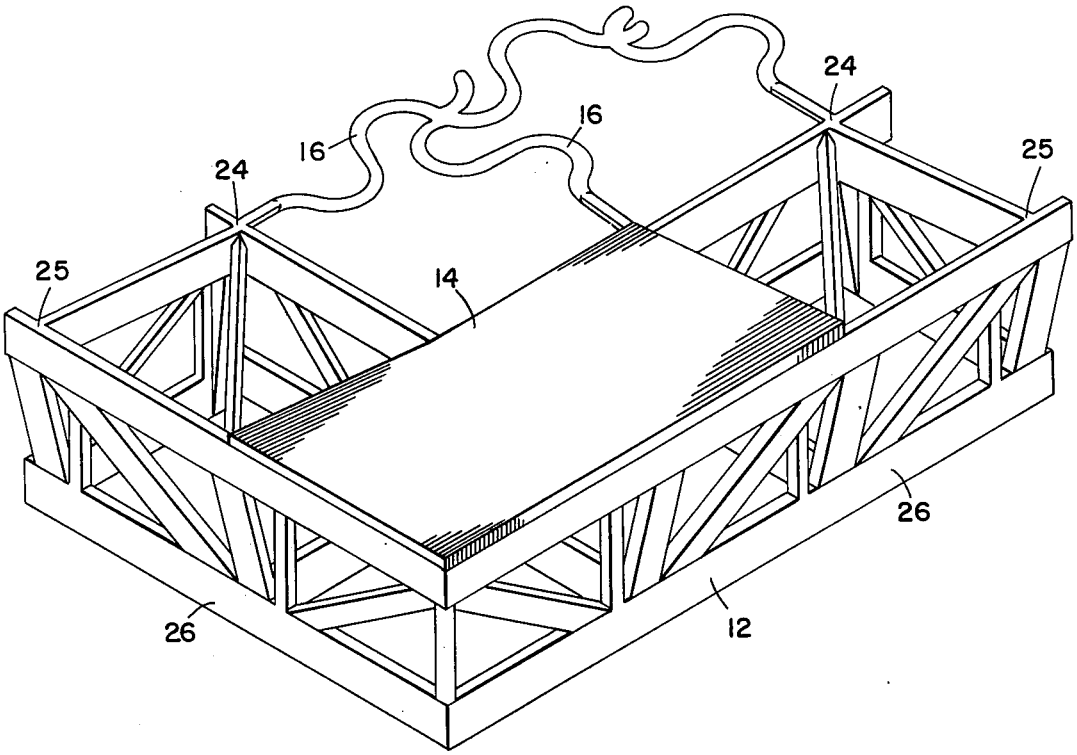
FIG. 2 is a partial perspective view of a portion of the novel unitary space frame of the instant invention, with springs and reinforcement connected thereto.

FIG. 2 illustrates a partial section of frame 12 having reinforcing means 14 and integral springs 16. It will be noted that the springs are shown to be an integral part of the injection molded frame-spring assembly, continuing from the frame at nodes 24. It is within the scope of the invention to substitute other spring means, such as conventional metal springs (not shown) to the frame 12 at nodes 24. FIG. 2 illustrates the lower integral segments 26 of frame 12 which may be utilized for attachment of upholstery by conventional hog rings that would snap over the lower grid. A thin metal plate or reinforcing means 14 is attached to either top or bottom or both sides of the integral injection molded frame 12 to form partial or total sandwich construction, as will be discussed later.

Figure 3:
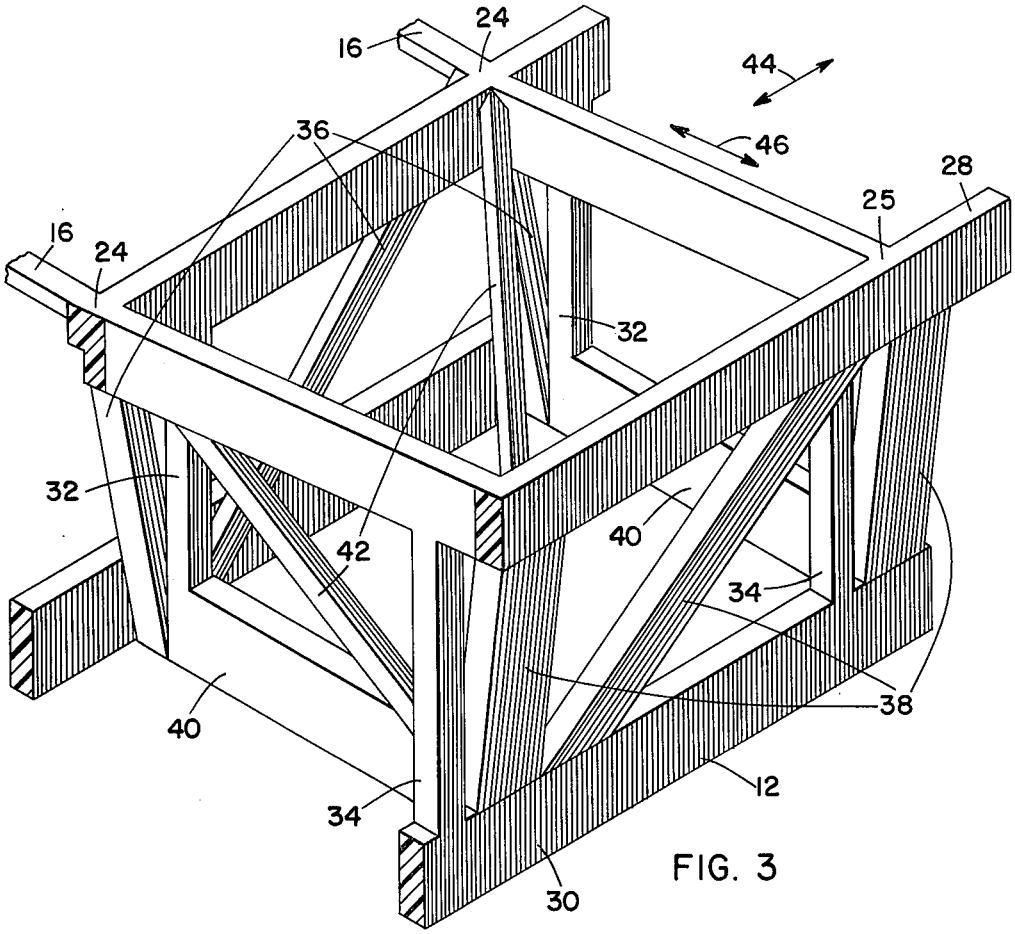
FIG. 3 is a partial cross-sectional perspective view of the repetitive frame cell utilized in the unitary frame of the instant invention.
Figure 4:
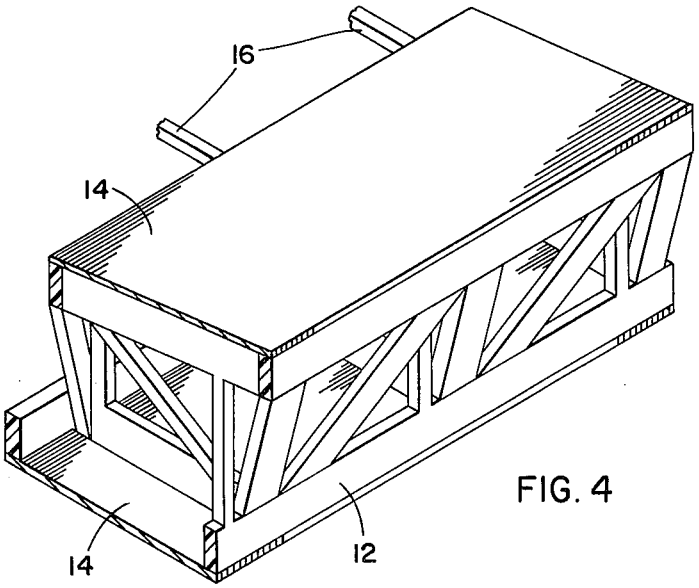
FIG. 4 is a partial cross-sectional view of a section of the unitary frame of the instant invention having a sandwiched plate construction for reinforcement.

FIG. 3 illustrates the basic cell of the frame 12, shown in FIGS. 1 and 2. The cell is a repetitive element used throughout the frame. The cell comprises an upper grid 28 and a lower grid 30. Lower grid 30 is comprised of integral segments 26, as discussed earlier. Upper grid 28 and lower grid 30 are generally parallel to each other but are offset from each other in plan, said plan defined by a lateral and longitudinal direction. The upper and lower grids are not necessarily identical or symmetrical. Grids 28 and 30 are interconnected by vertical members 32 and 34, said members being parallel to the direction of mold travel of a simple two piece mold that would be utilized to injection mold said frame 12 and said members 32 and 34 intersecting members in said grids that are angularly askew with respect to each other. This aspect of the frame is disclosed in our commonly owned patent, U.S. Pat. No. 3,854, 157. The instant frame cell further comprises a novel combination of additional elements, which provide superior strength and allow the cell to be repeated throughout the frame. A pair of "Z" shaped member means 36 and 38 connect the inside and outside nodal areas 24 and 25 respectively of the upper grid with the bottom grid. One additional center diagonal "V" shaped member means 42 interconnects the upper grid and nodal points 24 with the lower grid. The pair side "Z" shaped member means 36 and 38 resist shear movement in the longitudinal direction, defined by arrow 44. Center diagonal "V" shaped member means 42 resists shear movement in the lateral direction, as defined by direction arrow 46. The placement of the pair of side "Z" shaped member means 36 and 38 and center diagonal "V" shaped member means 42 in conjunction with the inside nodal points 24 provides solid connection points for integral spring members 16 or optional steel springs, as discussed previously, at these points. Again, it is important to note that the cell described above is repeated across the longitudinal direction to comprise one side of a frame, as shown in FIGS. 2 and 3. FIG. 4 illustrates frame 12 having plates 14 bonded thereto to make a sandwich construction. The plates can either be attached mechanically at the nodes by screws or by a bonding agent. The thin plates that are attached to the top and/or bottom of the space frame are the tension and compression load carrying members with space frame maintaining the position of these plates, i.e., transferring the shear loads between the plates.

Figure 5:
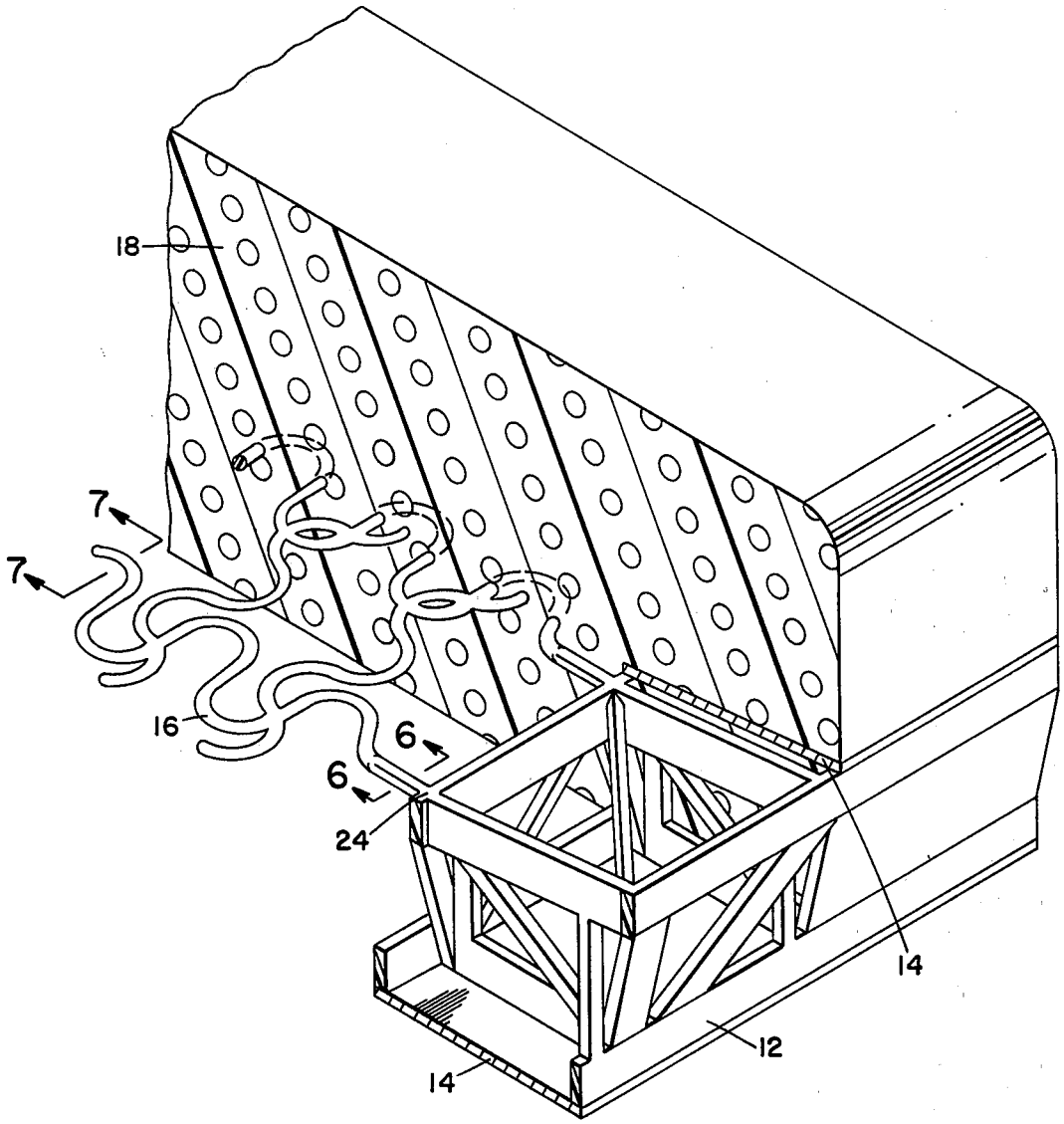
FIG. 5 is a partial perspective view of a section of the integral spring construction of the instant invention embedded in foam.
Figure 6:
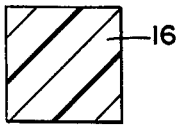
FIG. 6 is a cross-sectional view taken along section lines 6,6 in FIG. 5.
Figure 7:
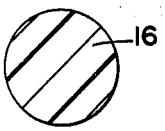
FIG. 7 is a cross-sectional view taken along section lines 7,7 in FIG. 5.

FIG. 5 illustrates integral spring members 16 having varying cross-sections, as shown in FIGS. 6 and 7. FIG. 6 illustrates an optimum load transfer cross-section and FIG. 7 illustrates an optimum torsional cross-section since torsion is the most efficient mode in which springs perform. In addition, a square cross-section is utilized at all points where crossing spring elements unite. FIG. 5 also illustrate the use of foamed in-place construction around the springs. The foaming over the springs and the frame makes a integral cushioned product that has the extra advantages of more uniform distribution of load over the structure, and, further, the benefit of molding the contour of the foamed surface so as to provide any desired modernistic shape and such benefits as lumbar support in a seat, et cetera.

Having described and illustrated the invetion in some detail, it will be understood that this description and the illustrations have been offered only by way of example and that the invention is to be limited in scope only by the appended claims.

What I claim and desire to protect by Letters Patent is:

1. A unitary space frame suitable for forming in a simple two peice mold having a direction of mold opening travel, said frame comprising a plurality of cells, each cell comprising:

an upper and a lower grid composed of grid members, said upper grid being offset from said lower grid in plan, said plan being defined by a lateral and longitudinal direction;

a plurality of first connecting members, each interconnecting a grid member in said upper grid and a grid member in said lower grid that are angularly askew, said first connecting members being oriented parallel to the direction of mold opening travel;

a pair of side "Z" shaped member means interconnecting said upper grid to said lower grid to resist shear movement of said upper and lower grids in the longitudinal direction; and a center diagonal "V" shaped member means connecting said upper grid and said lower grid to resist shear movement in the lateral direction, the surfaces of said pair of side "Z" shaped member means and said "V" shaped member means being entirely exposed along the direction of mold opening travel for molding through either said upper or said lower grid.

2. A frame as in claim 1 having integral spring members extending from said upper grid.

3. A frame as in claim 1 having separate spring members attached to said upper grid.

4. A frame as in claim 2 further including at least one plate bonded to said frame for reinforcement.

5. A frame as in claim 3 further including at least one plate bonded to said frame for reinforcement.

6. A frame as in claim 2 wherein said frame and integral spring members are embedded in a body of integral foam.

7. A frame as in claim 3 wherein said frame and separate spring members are embedded in a body of integral foam.

8. A frame as in claim 4 wherein said frame, plate and integral spring members are embedded in a body of integral foam.

9. A frame as in claim 5 wherein said frame, plate and separate spring members are embedded in a body of integral foam.

10. A frame as in claim 1 including at least one plate bonded to said frame for reinforcement.

* * * * *